US006474038B2

(12) United States Patent
Nien et al.

(10) Patent No.: US 6,474,038 B2
(45) Date of Patent: Nov. 5, 2002

(54) WINDOW SHUTTER FRAME ASSEMBLY AND METHOD FOR INSTALLATION

(75) Inventors: Keng-Hao Nien, Chang Hua (TW); Kendall W. Prince, Mesa, AZ (US)

(73) Assignee: Nien Made Enterprise Co., Ltd., Changhna (TW)

( * ) Notice: Subject to any disclaimer, the term of this patent is extended or adjusted under 35 U.S.C. 154(b) by 0 days.

(21) Appl. No.: 09/681,246

(22) Filed: Mar. 5, 2001

(65) Prior Publication Data

US 2002/0121067 A1 Sep. 5, 2002

(51) Int. Cl.[7] ..... E04F 19/02

(52) U.S. Cl. ..... 52/717.01; 52/211; 52/718.01; 52/312

(58) Field of Search ..... 52/211, 204.53, 52/716.1, 716.2, 718.01, 718.04, 717.01, 717.03, 717.05, 204.1, 288.1, 312

(56) References Cited

U.S. PATENT DOCUMENTS

| | | | | |
|---|---|---|---|---|
| 354,918 A | | 12/1886 | Lucht | |
| 482,742 A | | 12/1892 | Hoffend | |
| 1,424,658 A | | 8/1922 | Lidstone | |
| 1,603,366 A | | 10/1926 | Upson | |
| 1,988,236 A | | 1/1935 | Chatfield | |
| 2,048,132 A | | 7/1936 | Madsen | |
| 2,116,846 A | | 5/1938 | Pilcher | |
| 3,631,647 A | | 1/1972 | Merkin | |
| 3,775,926 A | | 12/1973 | Brown et al. | |
| 3,932,959 A | | 1/1976 | Jansons et al. | |
| 3,991,537 A | | 11/1976 | Brown | |
| 4,154,504 A | * | 5/1979 | Mohs | 350/97 |
| 4,504,168 A | | 3/1985 | Miller | |
| 4,706,431 A | | 11/1987 | Corvese | |
| 5,193,322 A | | 3/1993 | Wood | |
| 5,433,043 A | | 7/1995 | Hibbitt et al. | |
| 5,444,956 A | | 8/1995 | Searer et al. | |
| 5,463,835 A | | 11/1995 | Wood | |
| 5,490,353 A | | 2/1996 | McLaughlin | |
| 5,661,929 A | * | 9/1997 | Ross | 52/58 |
| 5,865,562 A | | 2/1999 | Mallek | |
| 5,918,434 A | | 7/1999 | Ballantyne et al. | |
| 5,979,132 A | | 11/1999 | Margarit | |
| 6,148,584 A | | 11/2000 | Wilson | |
| 6,182,405 B1 | | 2/2001 | Lindahl | |

* cited by examiner

*Primary Examiner*—Carl D. Friedman
*Assistant Examiner*—Jennifer I. Thissell
(74) *Attorney, Agent, or Firm*—Sheldon & Mak; Robert J. Rose

(57) ABSTRACT

A window shutter frame for attaching window shutters to a wall comprising an elongate frame base having a first length, a top surface, a bottom surface, and a first longitudinal axis, the top surface having a mounting channel with a first width, the mounting channel extending parallel to the first longitudinal axis of the frame base along the entire first length of the frame base, the mounting channel having a base surface and a first side surface and a second side surface, the base surface of the mounting channel having one or more mounting points through which fasteners may be disposed; and an elongate concealing strip for insertion into the mounting channel having a second width, a second length, and a second longitudinal axis, the second width of the concealing strip being approximately equal to the first width of the mounting channel, the second length of the concealing strip being approximately equal to the first length of the frame base, such that upon insertion of the concealing strip into the mounting channel the concealing strip is retained in the mounting channel by friction alone, and the mounting channel is concealed; method for installation, and a kit for installation.

15 Claims, 7 Drawing Sheets

WINDOW SHUTTER FRAME ASSEMBLY AND METHOD FOR INSTALLATION

BACKGROUND OF INVENTION

The invention relates generally to window shutter frame assemblies, and particularly to a window shutter frame assembly and system for installation that is suitable for non-professional installation.

Window shutters are a popular way to provide privacy in a room, and are an attractive alternative to blinds, shades, and drapes. Window shutters may be constructed from a variety of materials, although the most commonly used material is wood, finished either with traditional wood finishes, paint, or by a coating of plastic or other substance.

Regardless of the material used to construct window shutters, for any given window they will generally be heavier than a corresponding blind, shade, or drape. This requires that special attention be given by the installer to the installation of the shutter, so that it is securely attached to a wall or window frame, and does not detach upon continual use. One method for securely attaching a shutter is to first mount a rabbeted frame assembly around the perimeter of the window, and then to insert a pre-fabricated shutter panel assembly into the frame assembly. This modular approach should be popular with homeowners, since it permits a "do-it-yourself" homeowner or handyman to attach a window shutter with a minimum of carpentry knowledge.

A problem with existing window shutter frame assembly methods is that mounting of the frame assembly requires use of a secure fastening system, which is not easily concealed after installation. For example, as shown in FIG. 1, a screw fastener 11 is used to mount frame assembly 10 to wall 12. While providing a secure attachment for the frame assembly, the head of the screw fastener remains exposed, and will be unsightly. Methods are known to conceal such a screw fastener, including counter-sinking the screw, insertion of putty or synthetic wood over the head, and final finishing by sanding, paint or other material. Each of these methods, however, requires tools and carpentry knowledge that may be beyond that of the average "do-it-yourself" homeowner.

Another approach to mounting a window frame assembly is to use a smaller diameter fastener. For example, with reference to FIG. 2, a staple 13 is used to mount a frame assembly 10 to wall 12. A problem with this method is that it requires purchase of expensive staple gun hardware, and if not properly seated into wood wall framing, it results in a less than secure mount.

A further problem with existing methods for mounting window shutter frame assemblies is that the inside edge of the frame assembly will generally fall within the opening of the window, making accurate placement and leveling of the frame difficult for a non-professional installer.

Therefore, what is needed is a window frame assembly and method for installation that is easy to use for a non-professional installer, having provision for secure mounting, able to conceal mounting points after installation with concealing inserts, allowing for interchange of concealing inserts, and permitting easy and accurate placement and leveling about a window opening.

SUMMARY OF INVENTION

The present invention meets this need by providing a window frame assembly and method for installation that is easy to use for a non-professional installer, having provision for secure mounting, able to conceal mounting points after installation with concealing inserts, allowing for interchange of concealing inserts, and permitting easy and accurate placement and leveling about a window opening.

A window shutter frame for attaching window shutters to a wall at one or more mounting points, is provided comprising an elongate frame base having a first length, a top surface, a bottom surface, and a first longitudinal axis, the top surface having a mounting channel with a first width, the mounting channel extending parallel to the first longitudinal axis of the frame base along the entire first length of the frame base, the mounting channel having a base surface and a first side surface and a second side surface, the base surface of the mounting channel having one or more mounting points through which fasteners may be disposed; and an elongate concealing strip for insertion into the mounting channel having a second width, a second length, and a second longitudinal axis, the second width of the concealing strip being approximately equal to the first width of the mounting channel, the second length of the concealing strip being approximately equal to the first length of the frame base, such that upon insertion of the concealing strip into the mounting channel the concealing strip is retained in the mounting channel by friction alone, and the mounting channel is concealed.

The window shutter frame may further comprise a tongue extending along the entire mounting channel parallel to the first longitudinal axis of the frame base, and a groove extending along the entire second length of the concealing strip parallel to the second longitudinal axis of the concealing strip, such that upon insertion of the concealing strip into the mounting channel the tongue is disposed into the groove forming a locking junction.

The bottom surface of the frame base may further comprise a placement channel with a third width and a third length, the placement channel extending parallel to the first longitudinal axis of the frame base along the entire first length of the frame base.

A method is described for installation, including in one embodiment affixing a hanging strip to a wall, the hanging strip having a fourth width and a fourth length, the fourth width being approximately equal to the third width of the placement channel, and the fourth length being less than the third length of the placement channel so that upon placing the frame base over the hanging strip, the hanging strip is wholly contained within the placement channel.

A kit is provided comprising frame base members, concealing strips, hanging strip, and shutter panels.

BRIEF DESCRIPTION OF DRAWINGS

These and other features, aspects, and advantages of the present invention will become better understood with reference to the following description, appended claims, and accompanying drawings, where:

DETAILED DESCRIPTION

Figure 5:
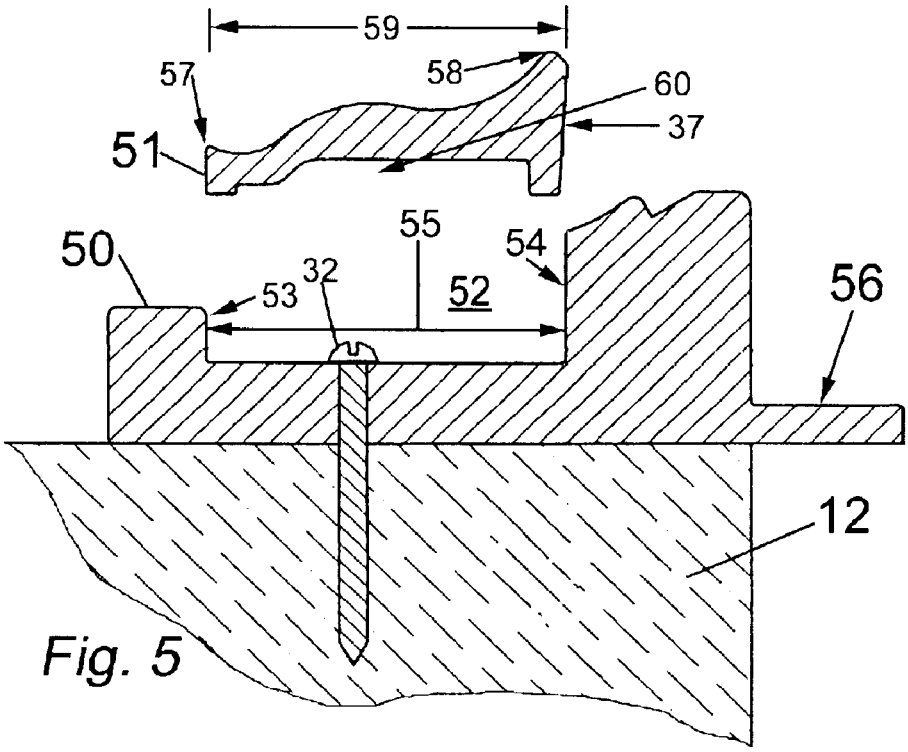
FIG. 5 is a sectional view of a window shutter frame assembly according to a further embodiment of the present invention, showing the wall, frame base, and concealing strip, prior to insertion of the concealing strip.

With reference to FIG. 5, in one embodiment of the present invention, a frame base 50 is provided in which a mounting channel 52 has been disposed along the longitudinal axis of the frame base, the mounting channel having a first side 53, a second side 54, and a width 55. The frame base will typically be constructed of wood and be provided to a consumer as a set of four members, pre-mitered, pre-sanded and pre-finished with paint, varnish, or other wood finish, so that the four pieces can be assembled to form a rectangular frame. The frame base may optionally contain a rabbeted edge 56 that will act as a stop for the folding shutter panels. The frame base may optionally be constructed of metal, plastic, or other rigid material.

The four frame base members are provided to the consumer with a first pair of two members of equal length and complementary 45 degree mitered ends, and a second pair of two members of equal length with 45 degree mitered ends complementary to the first pair. The consumer is provided with instructions for assembling the four frame members, or alternatively the four members may be provided pre-assembled. However assembled, the four frame base members can thus be made to any finished rectangular size. The four members will typically be provided as part of a kit, allowing the consumer to choose the kit appropriate for a given window size. Alternatively, the frame members may be sold in pairs. For example, a kit may be pre-packaged to form an assembly appropriate for a 3 foot by 4 foot window, or the consumer may choose a pair of side member for a 3 foot height window, and another pair of top/bottom members for a 4 foot wide window. Those skilled in the art will observe that it would be possible to have a frame assembly of only two side members.

The consumer, now having an assembled frame, holds the frame against the window opening in wall 12. It is now necessary to dispose one or more mounting points in the mounting channel 52, the mounting points being holes through which fastening means may be inserted completely through the frame base. Mounting points may be pre-drilled through the mounting channel 52, or the consumer may be instructed to drill holes in the mounting channel to act as mounting points. The location of the mounting points in the mounting channel 52 may be pre-marked with visible indicia, or left to the choice of the consumer. The consumer then inserts a screw fastener 32, or other appropriate fastener as is known to those skilled in the art, through each mounting point which is now disposed through the mounting channel 52, and by tightening the screw fastener 32 thereby secures the frame base 50 to the wall 12. While it would be possible to secure a frame base through a single mounting point, preferably multiple mounting points are used.

Having thus secured the frame base 50 to the wall 12, the head of the screw fastener 32 will still be visible. There is also provided an elongate concealing strip 51, which is constructed of wood, or optionally of metal, plastic, or other rigid material. With reference to FIG. 5, the concealing strip has a first corner 57, a second corner 58, a width 59, and a second side 37. The concealing strip will typically have a length along its longitudinal axis, and mitered ends, matching the length and mitered ends of the frame base into which it is intended to be inserted. The consumer places corner 57 of concealing strip 51 against the first side 53 of the mounting channel 52, and then inserts the concealing strip into mounting channel 52 by pressing down on corner 58 until the concealing strip 51 is rotated into place and firmly seated. It is necessary to size the width 59 of the concealing strip so that the strip is both held in place by friction upon insertion into the mounting channel, yet allowing sufficient clearance so that the concealing strip may be rotated into place. Typically this may be accomplished by making width 59 substantially identical to width 55. Depending upon the elasticity of the material used to construct both the concealing strip and the frame base, smaller or larger tolerances in the widths may be used, and techniques to establish appropriate tolerances will be evident to those skilled in the art. One technique would be to camber edge 37 by a small amount relative to the total width 59, thereby facilitating insertion of the concealing strip.

Figure 6:
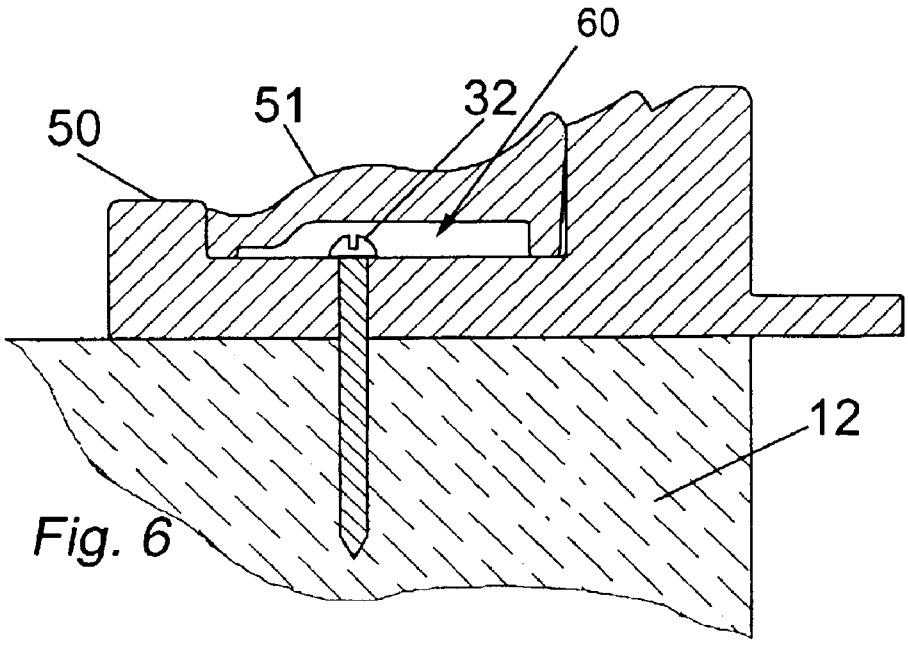
FIG. 6 is a sectional view of the window shutter frame assembly of FIG. 5 following insertion of the concealing strip.

As shown with reference to FIG. 6, it is necessary to dispose a channel 60 in the side of the concealing strip facing toward the frame base upon insertion, sufficient to permit clearance for the head of the screw fastener. If a flat head screw is used, the channel may be correspondingly shallow, or dispensed with entirely.

The mounting points, and screw heads of the screw fasteners inserted through the mounting points, are now concealed beneath the concealing strip. If the frame base and concealing strip have been pre-finished, the assembly is now complete, as shown in FIG. 6.

Figure 1:
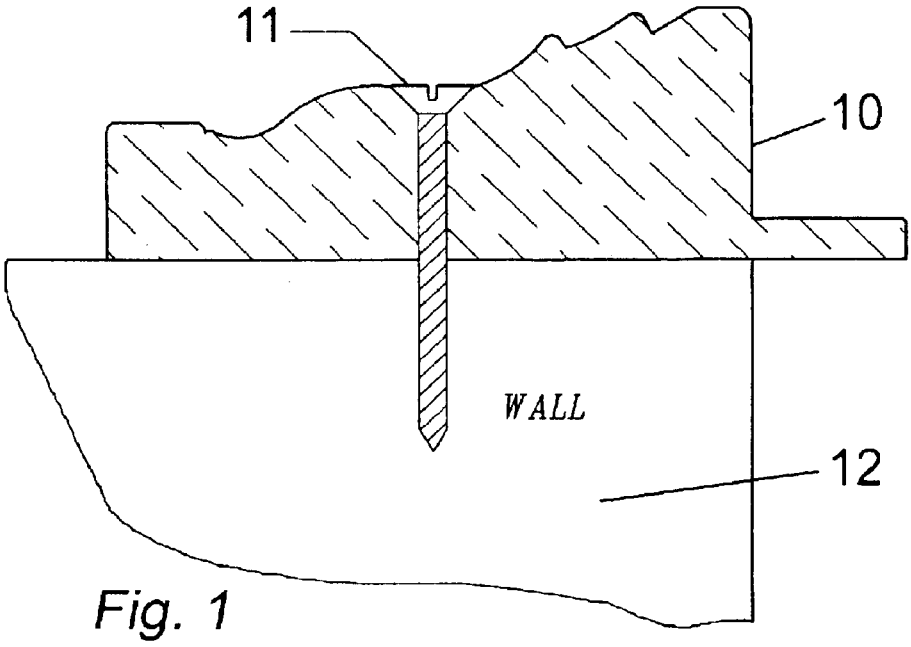
FIG. 1 is a sectional view of a window shutter frame showing a method of mounting using an exposed screw.
Figure 2:
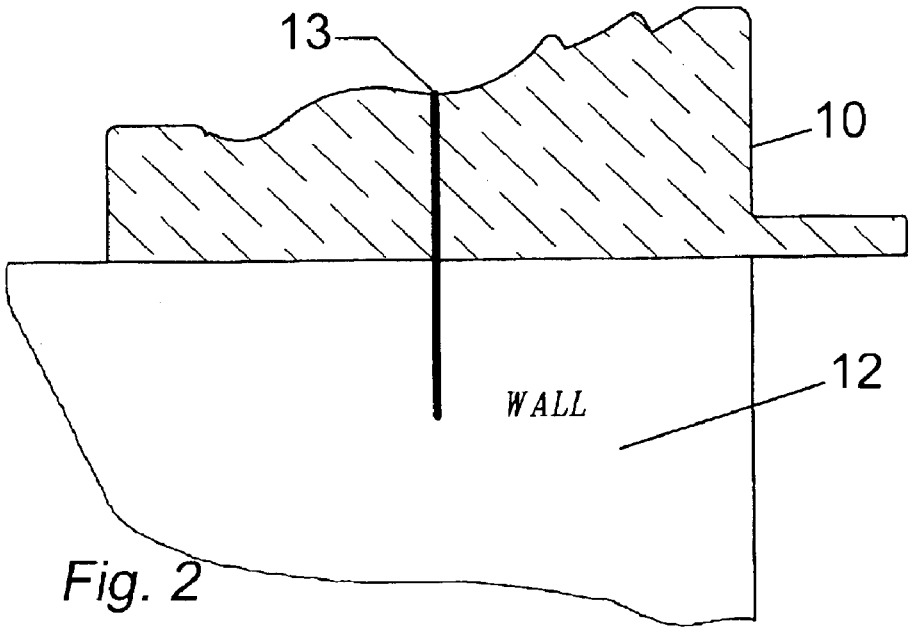
FIG. 2 is a sectional view of a window shutter frame showing a method of mounting using a staple.
Figure 3:
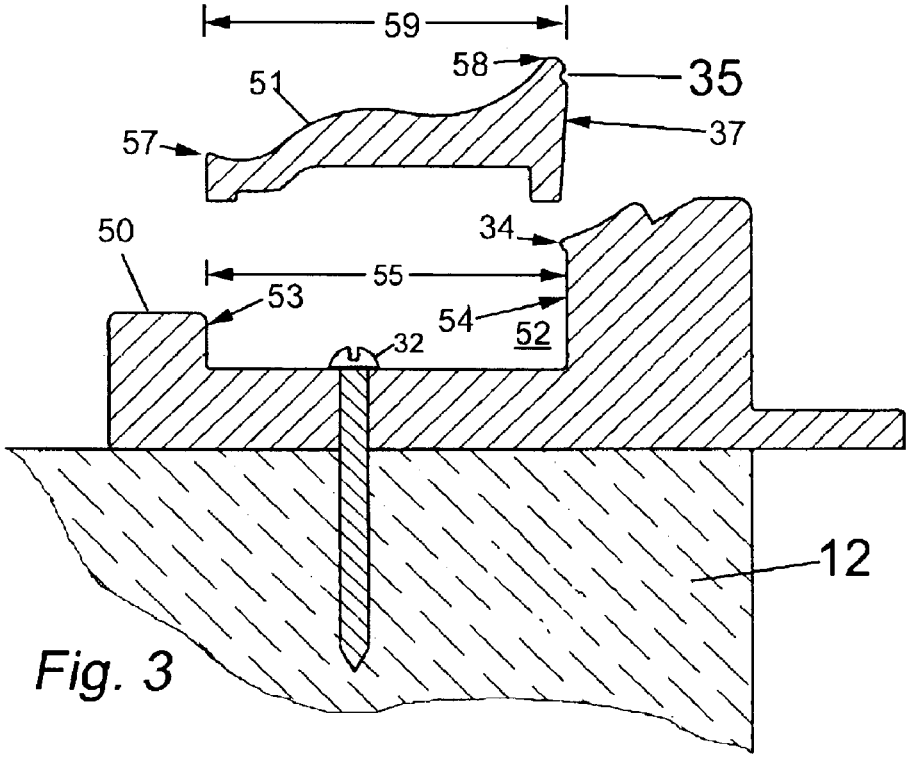
FIG. 3 is a sectional view of a window shutter frame assembly according to one embodiment of the present invention, showing the wall, frame base, concealing strip, and tongue/groove locking junction, prior to insertion of the concealing strip.

Another embodiment uses an interlocking tongue and groove joint to hold the concealing strip in place upon insertion. With reference to FIG. 3, the frame base 50 and concealing strip 51 are the same as in the first described embodiment, with the frame base further comprising a tongue 34 extending along the longitudinal axis of the second side 54 of frame base 50, and the concealing strip further comprising a groove 35 extending along the longitudinal axis of the second side 37 of concealing strip 51.

Figure 4:
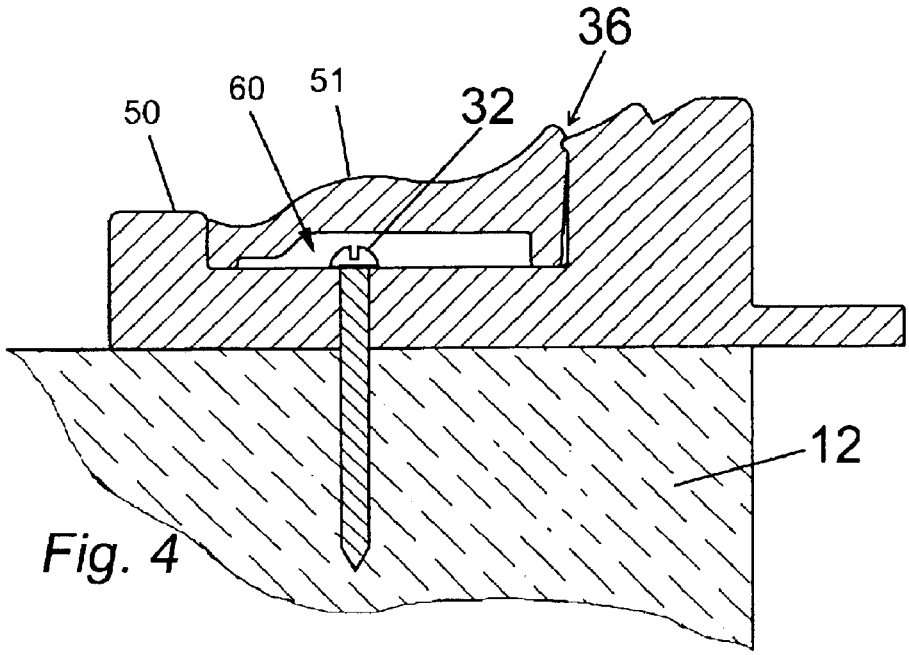
FIG. 4 is a sectional view of the window shutter frame assembly of FIG. 3 following insertion of the concealing strip.
Figure 11:
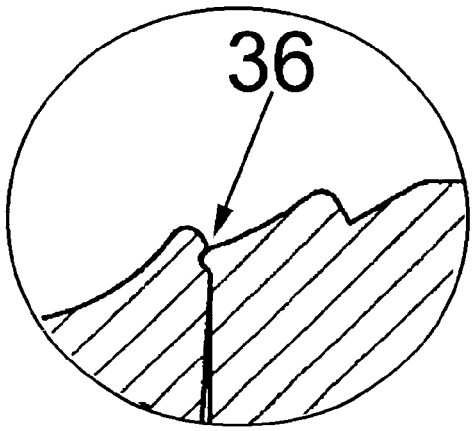
FIG. 11 is an exploded sectional view of tongue/groove locking junction of FIG. 3, following insertion of the concealing strip.

As in the first embodiment, the consumer places corner 57 of concealing strip 51 against the first side 53 of the mounting channel 52, and then inserts the concealing strip into mounting channel 52 by pressing down on corner 58 until the concealing strip 51 is rotated into place and firmly seated. With reference to FIG. 4, upon insertion of the concealing strip, a locking junction 36 is formed by the disposition of tongue 34 into groove 35, thereby contributing to the retention of the concealing strip within mounting channel 52. An exploded view of the locking junction 36 is shown in FIG. 11. While it is still necessary to size width 59 of the concealing strip so that it is substantially identical to width 55 of the mounting channel 52, the use of the locking junction 36 allows for larger tolerances in construction, yet yielding a secure fit. As in the first embodiment, depending upon the elasticity of the material used to construct both the concealing strip and the frame base, smaller or larger tolerances in the widths may be used, and techniques to establish appropriate tolerances will be evident to those skilled in the art.

As shown with reference to FIG. 4, it is again necessary to dispose a channel 60 in the side of the concealing strip facing toward the frame base upon insertion, sufficient to permit clearance for the head of the screw fastener. If a flat head screw is used, the channel may be correspondingly shallow, or dispensed with entirely. The mounting points, and screw heads of the screw fasteners inserted through the mounting points, are now concealed beneath the concealing strip. If the frame base and concealing strip have been pre-finished, the assembly is now complete, as shown in FIG. 4.

Figure 7:
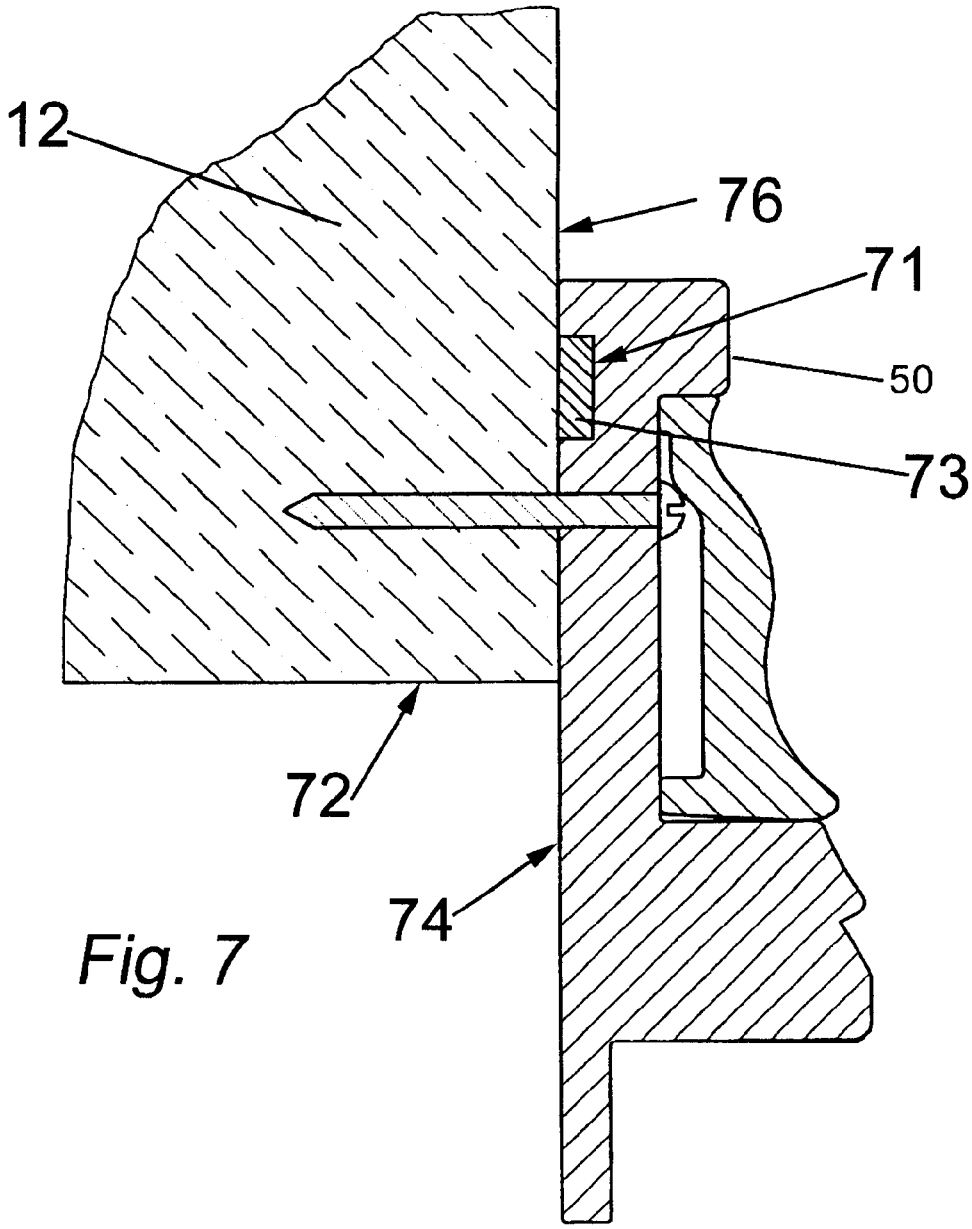
FIG. 7 is a sectional view of the top member of a window shutter frame according to a further embodiment of the present invention, showing the wall, frame base, inserted concealing strip, hanging strip, and placement channel.

With reference to FIG. 7, in another embodiment a elongate hanging strip 73 is provided, which may be constructed of wood, metal, plastic, or other rigid material. This hanging strip is secured on the wall 76 above the top edge 72 of the window opening in wall 12. Instructions may be given to the consumer to position the hanging strip at a set distance above edge 72, e.g., 2 inches, and this can easily be accomplished by a novice installer. The pre-set distance is calculated to position the finished frame base in a proper position about the window opening. Preferably the hanging strip will be leveled, and this may easily be accomplished by placing a level along the top or bottom of the hanging strip 73. Optionally, a level could be incorporated into the hanging strip.

In this embodiment, frame base 50 further comprises a placement channel 71 disposed along the longitudinal axis of the frame base, in the side 74 which is to be placed against the surface 76 of wall 12. The width of the placement channel 71 preferably should be approximately equal to the width of the hanging strip, although some tolerance can be permitted, as will be evident to those skilled in the art. The consumer places the frame base 50 so that the hanging strip is contained within the placement channel, yielding a level, accurate placement of the entire frame base. The hanging strip should be no longer than the length of the placement channel in the top member of the frame base assembly.

Figure 12:
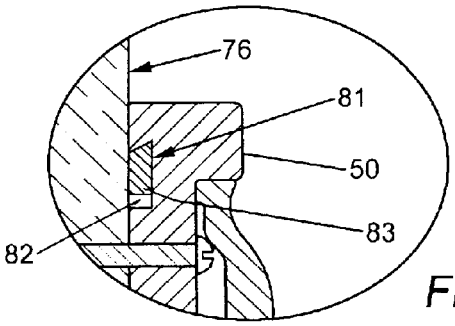
FIG. 12 is an exploded section view of the window shutter frame assembly of FIG. 7, showing a further embodiment of the hanging strip and placement channel.

Another embodiment of the hanging strip and placement channel is shown in exploded view FIG. 12. In this further embodiment, the hanging strip 83 may be considered to have a longitudinal length, a beveled top side facing away from the window opening, a back side which is to be placed against surface 76 of wall 12, and a front side which faces away from surface 76, the front side having a width. Hanging strip 81 is cut along its longitudinal length so that the top side forms, when seen in cross-section, an obtuse angle with the back side and an acute angle with the front side. The side of placement channel 81 which is to be disposed against the top side of the hanging strip should preferably be routed to a supplementary angle to the angle of the hanging strip, as shown in FIG. 12, thereby increasing the stability of the installation. Preferably, the width of the front side of the hanging strip should be no greater than the width of the opening of the placement channel, measured at the surface of frame base 50, so that frame base 50 may easily be position over the hanging strip and lowered into place. This will result in a small void 82 under the hanging strip 83.

Figure 8:
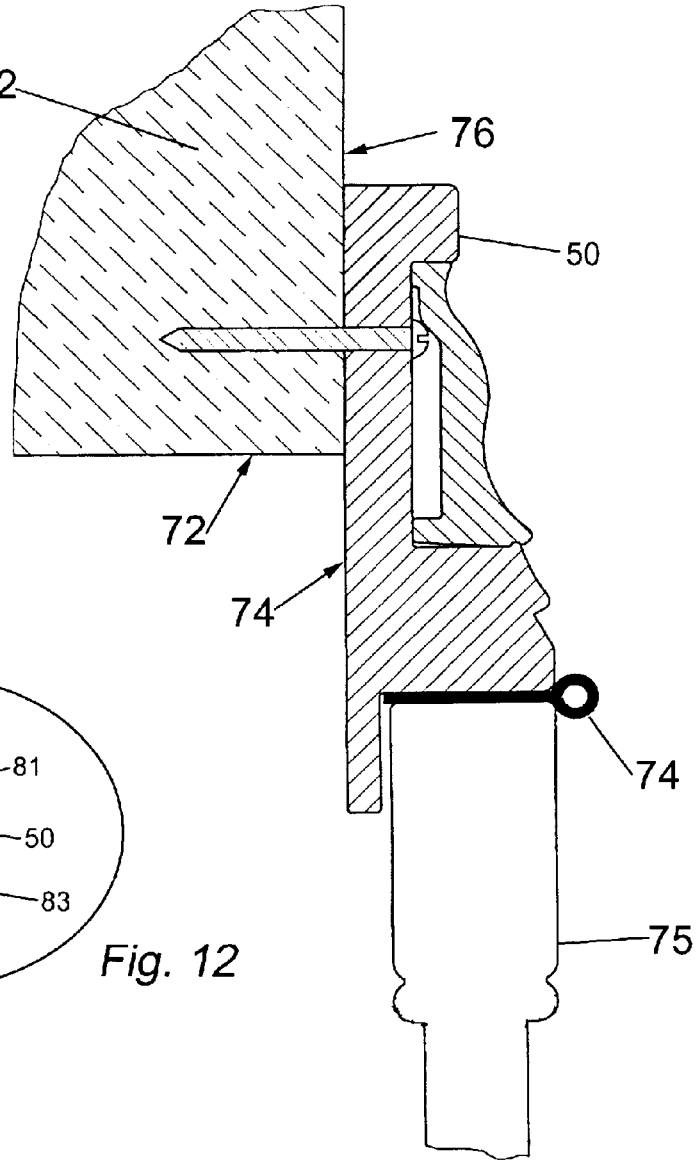
FIG. 8 is a sectional view of a side member of the window shutter frame of FIG. 7, showing the attached shutter panel and hinge.

With reference to FIG. 8, panel 75 comprising a shutter may be inserted into the frame base, securing the panel to a side member of frame base 50, using a hinge 74, or other fastening means as will be evident to those skilled in the art.

Figure 9:
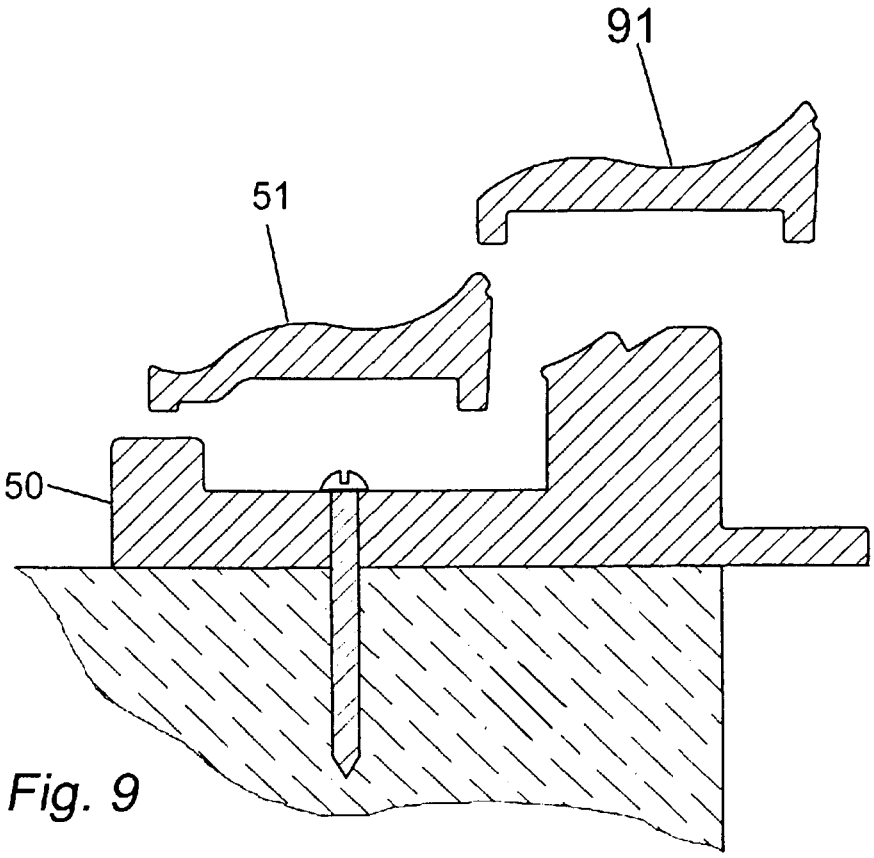
FIG. 9 is a sectional view of a window shutter frame assembly according to a further embodiment of the present invention, showing the wall, frame base, a first concealing strip, and a second concealing strip, subsequent to removal of the first concealing strip and prior to insertion of the second concealing strip.
Figure 10:
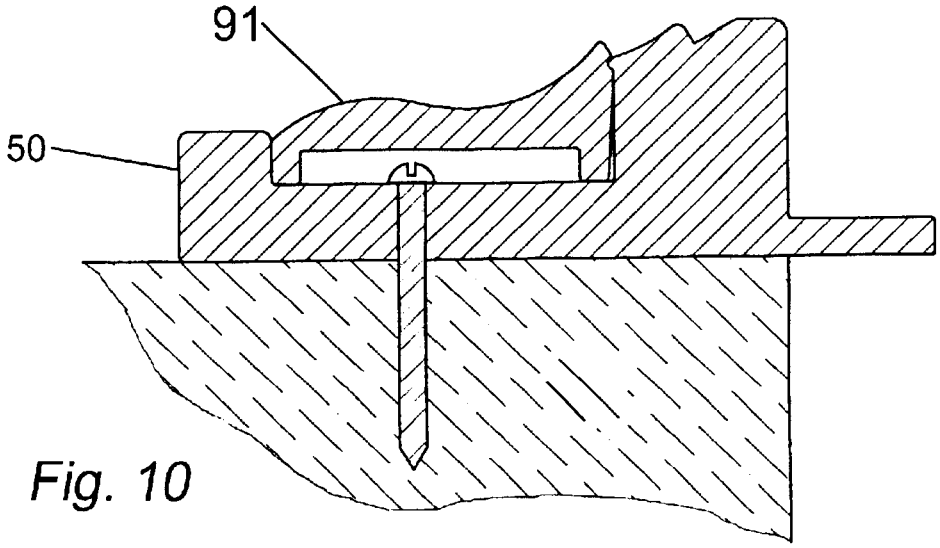
FIG. 10 is a sectional view of the window shutter frame assembly of FIG. 9, following insertion of the second concealing strip.
Figure 13:
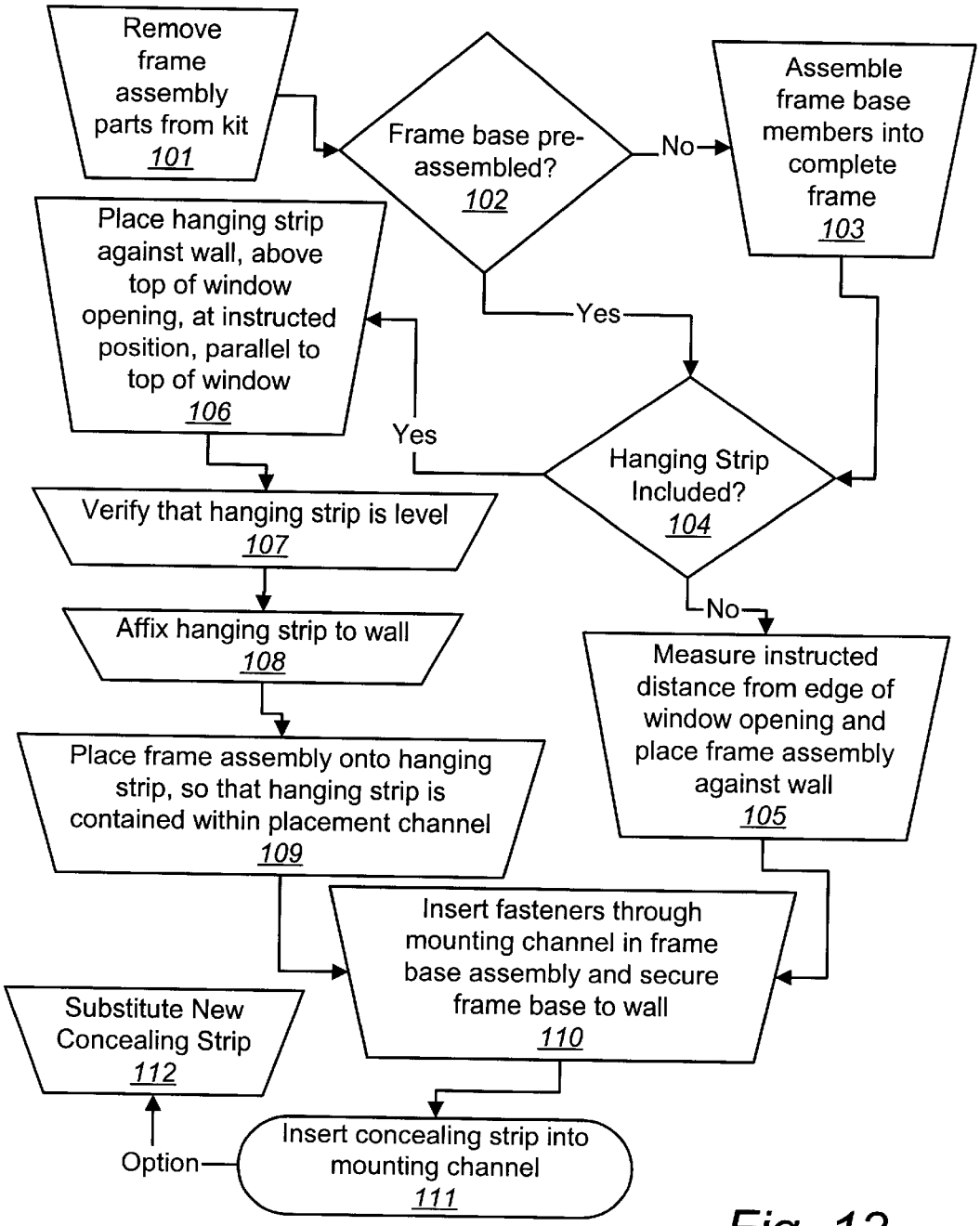
FIG. 13 is a flowchart showing the steps of the installation method according to the present invention.

In a further embodiment, with reference to FIG. 9, it is possible to remove concealing strip 51 after it has been inserted in mounting channel 52. This would be advantageous if removal or repositioning of the frame base was needed. Alternatively, a second concealing strip 91 could be inserted using one of the methods described above, thereby changing the appearance of the assembly. As shown in FIG. 10, the assembly now has a different appearance, which may be pleasing to the consumer.

A kit may be provided for sale to consumers, comprising frame base members, concealing strips and a hanging strip, according to one or more embodiments of the present invention, together with adequate numbers of fasteners, hinges and shutter panels to complete the installation, and written instructions in the method of installation described herein. For example, the kit may include one hanging strip with fasteners for attaching the hanging strip to the wall, four frame base members with fasteners to assemble the members into a complete frame assembly, four concealing strips, a supply of fasteners such as wood screws and wall anchors for attaching the frame assembly to a wall, four hinges, and a set of shutter panels for insertion into the frame assembly.

With reference to FIG. 7, the steps of the method for installation according to the present invention are as follows. The consumer or installer (referred to hereinafter as the installer) removes the frame assembly parts from the kit 101. If the frame base is pre-assembled 102, the installer proceeds to step 104, if not the installer proceeds to step 103, in which the installer assembles the frame base members into a complete frame. If a hanging strip is included 104, the installer proceeds to step 106, otherwise the installer proceeds to step 105.

In step 106 the installer places the hanging strip against a wall, above the top of the window opening, at a position instructed in the instructions, parallel to the top of the window opening. The strip is leveled if necessary 107, and it is affixed 108 to the wall. The assembled frame base is then placed onto the hanging strip, so that the hanging strip is contained within the placement channel 109.

In step 105, the installer measures the distances set forth in the instructions from the edge of the window opening, and places the assembly against the wall.

The method now proceeds with step 110, with the installer inserting fasteners through the mounting channel in the frame base, securing the frame base to the wall. The methods concludes 111 with the installer inserting the supplied concealing strips into the frame base. Optionally, the installer may substitute a new concealing strip 112 at a later time.

Although the present invention has been discussed in considerable detail with reference to certain preferred embodiments, other embodiments are possible. Therefore, the scope of the appended claims should not be limited to the description of preferred embodiments contained in this disclosure.

What is claimed is:

1. A window shutter frame for attaching window shutters to a wall comprising:

an elongate frame base having a first lengths a top surface, a bottom surface, and a first longitudinal axis, the top surface having a mounting channel with a first width, the mounting channel extending parallel to the first longitudinal axis of the frame base along the entire first length of the frame base, the mounting channel having a base surface and a first side surface and a second side surface, the base surface of the mounting channel having one or more mounting points through which fasteners may be disposed; and an elongate concealing strip for insertion into the mounting channel having a second width, a second length, a second bottom surface, a comer, and a second longitudinal axis, the second bottom surface comprising a concealment channel extending parallel to the second longitudinal axis along the second length of the concealing strip, the second width of the concealing strip being approximately equal to the first width of the mounting channel, the second length of the concealing strip being approximately equal to the first length of the frame base, such that upon insertion of the concealing strip into the mounting channel the concealing strip is retained in the mounting channel by friction alone, and the mounting channel is concealed.

2. The window shutter frame of claim 1, the bottom surface of the frame base further comprising a placement channel with a third width and a third length, the placement channel extending parallel to the first longitudinal axis of the frame base along the entire first length of the frame base.

3. The window shutter frame of claim 1, the base surface of the mounting channel further comprising one or more visible indicia for indicating the location of a mounting point.

4. The window shutter frame of claim 1, the base surface of the mounting channel further comprising a hole at the location of a mounting point.

5. The window shutter frame of claim 1, wherein the concealing strip is to be inserted into the mounting channel by placing the corner of the concealing strip against the first side surface of the mounting channel and then rotating the concealing strip into the mounting channel.

6. The window shutter frame of claim 1, the frame base further comprising a rabbeted side edge surface extending parallel to the first longitudinal axis along the entire first length of the frame base.

7. A method for mounting a window shutter assembly to a wall comprising the steps of:

fastening to a wall an elongate frame base having a first length, a top surface, a bottom surface, and a first longitudinal axis, the top surface having a mounting channel with a first width, the mounting channel extending parallel to the first longitudinal axis of the frame base along the entire first length of the frame base, the mounting channel having a base surface and a first side surface and a second side surface, the base surface of the mounting channel having one or more mounting points through which fasteners may be disposed, the bottom surface of the frame base comprising a placement channel with a third width and a third length, the placement channel extending parallel to the first longitudinal axis of the frame base along the entire first length of the frame base;

inserting into the mounting channel in the frame base an elongate concealing strip having a second width, a second length, a comer, and a second longitudinal axis, the second width of the concealing strip being approximately equal to the first width of the mounting channel, the second length of the concealing strip being approximately equal to the first length of the frame base, by placing the comer of the concealing strip against the first side surface of the mounting channel and then rotating the concealing strip into the mounting channel such that upon insertion of the concealing strip into the mounting channel the concealing strip is retained in the mounting channel by friction alone, and the mounting channel is concealed;

affixing a hanging strip to a wall, the hanging strip having a fourth width and a fourth length, the fourth width being approximately equal to the third width of the placement channel, and the fourth length being less than the third length of the placement channel; and placing the frame base over the hanging strip so that the hanging strip is wholly contained within die placement channel.

8. The method of claim 7, the base surface of the mounting channel comprising one or more visible indicia for indicating the location of a mounting point.

9. The method of claim 7, the base surface of the mounting channel comprising a hole at the location of a mounting point.

10. The method of claim 7, the frame base further comprising a rabbeted side edge surface extending parallel to the first longitudinal axis along the entire first length of the frame base.

11. A window shutter assembly mounting kit comprising:

an elongate frame base having a first length, a top surface, a bottom surface, and a first longitudinal axis, the top surface having a mounting channel with a first width, the mounting channel extending parallel to the first longitudinal axis of the frame base along the entire first length of the frame base, the mounting channel having a base surface and a first side surface and a second side surface, the base surface of the mounting channel having one or more mounting points through which fasteners may be disposed, the bottom surface of the frame base Fuhrer comprising a placement channel with a third width and a third length; the placement channel extending parallel to the first longitudinal axis of the frame base along the entire first length of the frame base;

an elongate concealing strip for insertion into the mounting channel having a second width, a second length a comer, and a second longitudinal axis, the second width of the concealing strip being approximately equal to the first width of the mounting channel, the second length of the concealing strip being approximately equal to the first length of the frame base, such that upon insertion of the concealing strip into the mounting channel the concealing strip is retained in the mounting channel by friction alone, and the mounting channel is concealed; and a hanging strip having a fourth width and a fourth length the fourth width being approximately equal To the third width of the placement channel, and the fourth length being less than the third length of the placement channel.

12. The kit of claim 11, the base surface of the mounting channel further comprising one or more visible indicia for indicating the location of a mounting point.

13. The kit of claim 11, the base surface of the mounting channel further comprising a hole at the location of a mounting point.

14. The kit of claim 11, wherein the concealing strip is to be inserted into the mounting channel by placing the corner of the concealing strip against the first side surface of the mounting channel and then rotating the concealing strip into the mounting channel.

15. The kit of claim 11, the frame base further comprising a rabbeted side edge surface extending parallel to the first longitudinal axis along the entire first length of the frame base.

* * * * *